United States Patent [19]

Fulkerson

[11] Patent Number: 4,482,013

[45] Date of Patent: Nov. 13, 1984

[54] MECHANICAL WIRELINE BOREHOLE PACKER

[75] Inventor: Larry R. Fulkerson, Sandy, Utah

[73] Assignee: Norton Christensen, Inc., Salt Lake City, Utah

[21] Appl. No.: 497,302

[22] Filed: May 23, 1983

[51] Int. Cl.[3] ..... E21B 33/12

[52] U.S. Cl. ..... 166/118; 166/202; 175/317; 175/321

[58] Field of Search ..... 175/48, 50, 232, 243, 175/317, 321; 166/250, 192, 179, 120, 115, 202, 135, 118

[56] References Cited

U.S. PATENT DOCUMENTS

| | | | |
|---|---|---|---|
| 2,230,712 | 2/1941 | Bendeler et al. | 166/123 |
| 2,618,345 | 11/1952 | Tucker | 166/135 |
| 2,691,418 | 10/1954 | Connolly | 166/129 |
| 2,854,080 | 9/1958 | Dale et al. | 166/140 |
| 3,646,995 | 3/1972 | Manes et al. | 166/336 |
| 3,741,305 | 6/1973 | Young et al. | 166/250 |
| 4,357,992 | 11/1982 | Sweeney | 166/250 |

FOREIGN PATENT DOCUMENTS

| | | | |
|---|---|---|---|
| 670721 | 7/1979 | U.S.S.R. | 166/179 |

*Primary Examiner*—James A. Leppink
*Assistant Examiner*—Hoang C. Dang

[57] ABSTRACT

A wireline supported mechanically operable packer device (10) for use in a drill string (DS) casing (C) and attached core drill bit (B) raised off the bottom of a borehole and testing the formation below has a housing (12) adapted to engage an arresting internal shoulder (S) of the core drill bit (B). A hollow inner mandrel (40) slideable in the housing has attached thereto a packer seal cup (P) an O-ring seal (P) expander (50) weight means (60) and wireline means (70) (80) moveable between stops (16) (18) determining the extended and contracted positions thereof relative to the housing. Upon lowering the wireline (70) (80) and weight means (60) the attached inner mandrel continues its downward movement relative to the arrested housing (12) and toward the contracted, locked sealing position, and thereby actuates means (30) locking the housing to the casing (C), ejects the initially contracted and stored packer seal (P) from an end chamber of the housing whereupon it expands into sealing engagement with the borehole wall below and the expander means expands the O-ring (R) against the internal surface of the casing. Fluid under pressure is then pumped through casing (C) and inner mandrel to test formation after which the packer device can be retrieved and hoisted out by wireline whereby a reverse sequence of movements of the various elements occurs during return of the device to its initial extended unlocked non-sealing position.

9 Claims, 5 Drawing Figures

MECHANICAL WIRELINE BOREHOLE PACKER

TECHNICAL DISCLOSURE

A mechanical bore hole packer device for testing earth formations is adapted for use with a wireline, within a drill string casing and activated upon contacting the inner shoulder of a core drill bit raised off the bottom of the bore hole. A weighted inner hollow mandrel slidable within a housing supports a resilient seal cup initially drawn into, contracted and stored in the housing until ejected by the inner mandrel and allowed to expand into sealing engagement with the bore hole wall. Thus, fluid under pressure may be pumped directly through the drill string and inner mandrel to the test site below the packer seal.

BACKGROUND OF THE INVENTION

1. Field of the Invention

The invention relates to a bore hole packer device provided with resilient seal means expandable against the borehole wall for sealing off and subsequently testing a zone of the formation downhole.

2. Description of the Prior Art

Heretofore, a number of borehole packers for sealing off and pressure testing zones of earth formations require a source of air or gas pressure at and a conduit from the surface to expand or inflate a resilient bladder or seal against the bore hole wall. Others, disclosed in U.S. Pat. Nos. 2,854,080, 3,646,995 and 3,741,305, require a pipe string extending from the surface and connected to an inner telescoping mandrel to mechanically position, activate and retrieve the packer device. Setting of the packer is attained by force applied to the inner pipe string which axially shift expander sleeves, cones, or slips, to compress and/or expand resilient means into sealing engagement with the casing or borehole wall.

A similar packer disclosed in U.S. Pat. No. 2,691,418 utilizes a resilient cup like seal including toothed slips for engaging a casing or bore hole wall. The packer is lowered to and retrieved from a site downhole by a pipe string attached to an inner fluid conduit coupled to the cup seal retaining sleeve by a pin projecting into a J-slot in the sleeve. Rotating the pin from the J-slot allows the fluid conduit and attached valve head to be raised into sealing engagement with a valve seat on the retaining sleeve and thus prevent escape of fluid under pressure passed through the conduit, expand the cup seal, seal off a lower zone of the bore hole and test the adjacent formation.

Unlike prior art packers the applicant's device is used in combination with a core drill bit or like sub attached to the lower end of a drill string casing and raised to the desired site above the bottom of the bore hole after taking a core sample of the formation.

The device is lowered into and retrieved from the drill string by a conventional wireline and latch mechanism attached to an inner telescopic hollow mandrel and housing. A resilient cup seal attached to the lower end of the mandrel is initially contracted and retained within an end chamber of a housing which upon being arrested by an internal shoulder of the drill bit causes continued relative downward movement of the mandrel to eject the cup seal from the end chamber, and allow expansion thereof against the bore hole wall. Fluid can then be pumped directly down through the drill string and inner mandrel to test the formation below.

SUMMARY OF THE INVENTION

A mechanically operable, wireline and drill string core drill bit supported packer device for sealing off and pressure testing the formation about a section of a bore hole situated below a core bit attached to a drill string and raised to a site above the bottom of the bore hole. The device comprises a wireline quad latch mechanism attached to the upper end of a heavy weight rod or shaft attached to the upper end of an inner hollow mandrel slideable within an outer housing between an extended unlocked non-sealing position and a contracted locked sealing position. An inverted cup like resilient seal attached to the lower end of the inner mandrel is initially contracted into and stored in a pleated condition within a smaller diameter end chamber in the housing. The lower end of the housing is adapted to contact an internal shoulder within a core drill bit whereafter the extended weighted inner mandrel and attached cup seal moves downwardly relative to the housing to the contracted locked sealing position, the cup seal is ejected from the end chamber and expands against the bore hole wall.

An O-ring seal seated on the upper annular end surface of the housing initially surrounds a portion of smaller diameter about the extended mandrel and is expanded radially into compressive sealing engagement with the internal surface of the drill string casing by a tapered and larger diameter surface portions about the inner mandrel during movement thereof to the contracted locked sealing position. The housing has radial bores containing locking means or balls normally maintained inwardly of the external surface of the housing and partially in an annular bevelled groove in the mandrel which upon being moved to the contracted locked sealing position forces the locking means or balls outwardly into locking engagement with an internal annular beveled groove in the wall of the drill string casing. Fluid under pressure then pumped down the drill string is obstructed by the O-ring seal and thus enters a radial passage and passes axially through the inner hollow mandrel, exerts pressure against the cup seal and tests the formation below in the conventional manner.

Retrieval of the device is by pulling upon the attached wireline, whereupon the mandrel and attached cup seal move upwardly, relative to the locked housing, toward the extended non-sealing unlocked position. During this movement of the mandrel the cup seal first contracts and enters the end chamber, the O-ring seal returns to its initial contracted non-sealing relaxed state and lastly the locking means returns to the unlocked state and releases the housing and packer device from the drill string casing.

DESCRIPTION OF THE PREFERRED EMBODIMENT(S)

Figure 1:
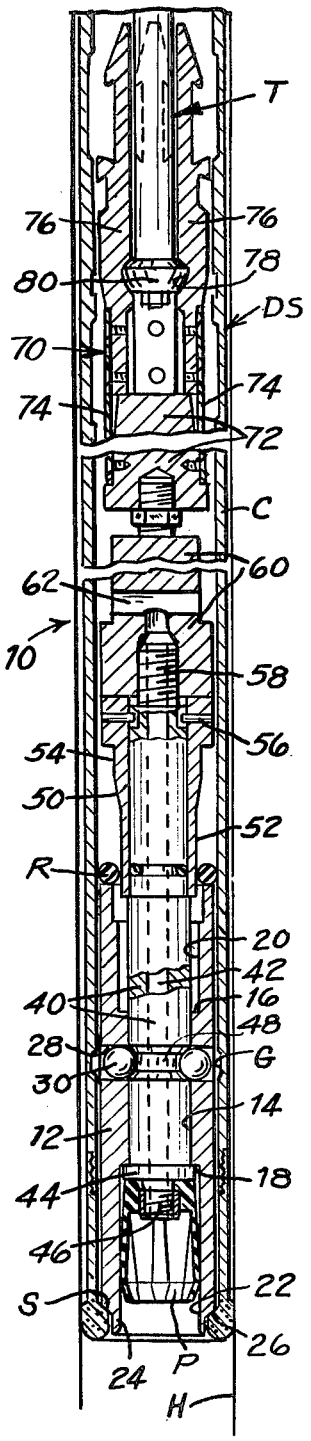
FIG. 1 is a vertical cross sectional view of the packer device according to the invention shown in the prepacked, extended, non-locked, non-sealing position and lowered by wireline within a drill string casing into engagement with an internal shoulder of a core drill bit previously raised to a predetermined site off and above the bottom of the bore hole.
Figure 2:
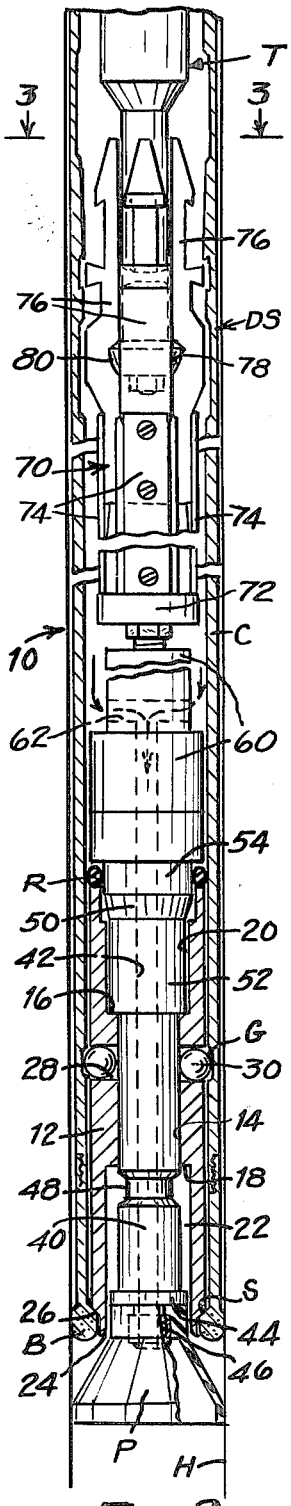
FIG. 2 is a vertical cross sectional view of the packer device of FIG. 1 shown in a contracted locked sealing position following downward movement of the inner mandrel and ejecting of the prepacked packer seal cup from the end chamber in the housing and expansion thereof against the bore hole wall, radial expansion of an upper O-ring seal against the drill string casing and actuation of the locking means.
Figure 3:
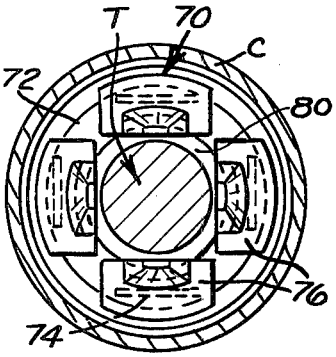
FIG. 3 is a cross sectional view through a typical quad type wireline latch mechanism taken on line 3—3 of FIG. 2.

A mechanically operable, wireline depositable and retrievable packer device 10 for pressure testing formation about a borehole is shown in FIGS. 1 and 2. The packer device 10 is adapted for use within a drill string DS including a casing C having an internal annular beveled locking notch or groove G and attached core drill bit B with an internal annular beveled shoulder or inclined surface S raised to a specific site above the bottom of a bore hole H following the taking and removal of a core sample.

The packer device 10 comprises an outer housing 12 having a maximum outer diameter less than the internal diameter of the casing C but greater than the diameter of the central bore in the crown of the core drill bit B adjacent the beveled shoulder S engaged by a mating annular inclined shoulder or surface adjacent the lower end of the housing adapted to protrude through the central bore in the crown of the core drill bit C. The housing 12 has, intermediate its opposite upper flat and lower beveled ends or surfaces, a central internal bore 14 extending axially between upper and lower annular shoulders or stop surfaces 16 and 18 adjoining respective upper and lower end chambers 20 and 22 of greater diameter. At its lower exit end the housing 12 has an annular end portion 24 adapted to protrude through the crown of core bit B from an annular inclined or beveled external shoulder or stop surface 26 adapted to matingly engage the internal shoulder S of the bit B.

One or more radial bores 28 extend transversely through the wall of the housing and intersect the central bore 14. The exit end opening of the bore 28 adjoining the periphery of housing 12 is preferably reduced in diameter sufficiently to retain locking means or balls 30 and yet allow them to project radially beyond the exterior surface of the housing sufficiently to lockingly engage the locking groove G in the casing C.

Within the central bore 14 of housing 12 is slidably mounted an inner hollow mandrel 40 with a central passage or bore 42 extending between opposite upper and lower end portions thereof. At its lower end the mandrel has an annular flange and shoulder 44 adapted for engagement with the annular stop surface 18 and an adjoining seal retaining means. The retaining means may include a grooved retaining head portion over which the upper thicker base portion of a resilent truncated hollow cone shape packer or seal cup P including an initially smaller stepped central aperture has been expanded and contracted into locking engagement and movement therewith. Preferably the seal retaining means comprises an internally threaded nut 46 bonded to the recessed upper base portion of the packer seal means and threaded onto the lower threaded end portion of the inner mandrel extending from the flange 44. Alternatively, the nut need not be bonded to the seal cup but merely threaded onto the lower threaded end portion of the inner mandrel and thereby clamp the upper portion of the seal cup against the flange 44.

An annular groove 48 between axially spaced oppositely beveled shoulders or surfaces is provided in an intermediate portion of the inner mandrel and into which the locking balls 30 can extend when the inner mandrel is in the extended nonlocking and nonsealing position relative to the housing as shown in FIG. 1.

Attached, keyed and sealed to an adjacent upper portion of the inner mandrel 40 is a removable O-ring or seal ring expander or tapered sleeve 50. An end portion 52 of the sleeve 50 movable within the upper chamber 20 has a lower end surface adapted to engage housing stop surface or shoulder 16 and thereby limit the axial downward contracting movement of the inner mandrel 12 and attached packer cup seal P to a predetermined amount relative to the arrested housing 12 as shown in FIG. 2. The expander sleeve 50 has an intermediate tapered or beveled portion and surface extending outwardly and upwardly at an incline from the lower portion 52 of smaller diameter to an upper portion 54 of sufficiently larger diameter adapted to sealingly engage, expand and compress the surrrounding resilient O-ring seal R seated on the upper end surface of the housing 12 into sealing engagement with the internal surface of the casing C and seal the annular spaces between housing, casing and inner mandrel.

To prevent relative rotation the sleeve 50 is keyed to the mandrel by keys or pins 56 extending radially through an upper flanged portion thereof and into slots or recesses adjacent the upper threaded end portion 58 of the inner mandrel 40 threaded into the lower end of additional weight means such as an extension portion of the inner mandrel itself or rod or shaft 60 locking the sleeve 50 to the mandrel 40.

Alternatively the tapered expander sleeve 50 may be made as an integral part of the inner mandrel 40 whereby the keyes 56 and internal O-ring seal therebetween becomes unnecessary. Thus, the lower end portion of the inner mandrel including the flange 44 and retainer means 46 could be made as a separate removable member threaded to or attached to the lower end of the inner mandrel 40 in any well known suitable manner.

The weight rod or coupling 60 is actually about 5 ft. (1.5 m) and of greater axial length then shown broken away in the drawings and hence of sufficient weight to displace the inner mandrel 40, the attached expander 50 and stored collasped packer cup seal P downwardly relative to the arrested housing 12 and drill bit B to the contracted, locked and sealing position shown in FIG. 2. Alternatively, the inner mandrel could be extended sufficiently to provide the additional weight means to displace itself relative to the housing and connected to the wireline means.

A transverse radial fluid passage 62 provided in the weight rod 60 intersects an axial passage aligned with the axial passage 42 in the inner hollow mandrel 40. Thus, fluid pumped down the drill may pass on through the device to pressure test the section of the bore hole formation below and sealed off by the expanded packer cup seal as shown in FIG. 2.

Threaded and locked to the upper end of the weight rod coupling 60 is a conventional quad wireline latch means or mechanism 70 comprising a central inwardly tapered support shaft 72 to which four equally angularly spaced elongated resilient strips or springs 74 are attached and extend upwardly along sides thereof to upper ends fixed to two pair of opposing latches 76. The equally angularly spaced latches 76 have lower ends that move radially along or close to the upper end of the support shaft 72 and are normally biased by the springs 74 inwardly toward the central axis of the device and the opposing latch.

Each latch 76 has an internal arcuate shape slot or recess 78 adapted to receive, positively grip and latch onto the inserted enlarged latching plug or head 80 at the lower end of a conventional NX wireline lowering tool T attached to the usual swivel plug and wireline assembly (not shown) for lowering and hoisting of the device in the well known manner.

A suitable NX wireline quadlatch, lowering and hoisting tool assembly for attachment to, placing and retrieving the above described packer device is commercially available from Christensen Diamim Tools Inc., Salt Lake City, Utah.

The packer device 10 initially in the inoperative extended, nonsealing and unlocked position shown in FIG. 1 is displaced to and set in the operative contracted, locked and sealing position shown in FIG. 2 as follows:

A conventional NX quadlatch wireline lowering and hoisting tool assembly is attached to the device by inserting the enlarged latching head 80 into locking engagement with the latches 76.

As conventionally known and done in the art, a slotted lowering tool funnel is placed around the latches 76 to prevent radial movement thereof and premature release of the device during insertion into the drill string casing C.

The device supported by the wireline in the extended position with mandrel flange 44 against housing shoulder 18 as seen in FIG. 1 and the lower end portion of the funnel are inserted into the upper end of the drill string casing which supports and arrests movement of the slotted funnel which funnels the downwardly moving latches into the closely fitting drill string casing which then prevents the latches 76 from releasing the lowering tool head 80. If desired the slotted funnel can then be removed by passing the wireline through the side slot therein.

The packer device 10 is lowered by wireline into engagement with the internal beveled shoulder S of the core drill bit B previously raised to a predetermined distance and site above the bottom of the bore hole H from which a core sample has been taken and removed in the known manner.

When beveled shoulder 26 of the housing 12 engages the shoulder S of the core bit B the downward movement of housing 12 is arrested and the continued lowering of the wireline allows the inner mandrel 40 to move downwardly relative to the housing under the influence of its own weight and additional weight of the attached weight rod 60 and quad latch means 70.

During simultaneous downward movement of the inner mandrel 12, packer cup seal P and expander sleeve 50, the locking means or balls 30 are first forced radially outwardly into the internal groove G and lock the housing to the drill string casing. Thereafter, the tapered portion of the expander sleeve 50 contacts, expands and compresses the O-ring R against the casing C and seals the annulus between the device and casing and simultaneously therewith the previously contracted and pleated resilient packer seal seal cup P moves out of the chamber 22 and expands against the wall of the bore hole H. Downward movement of the inner mandrel is arrested when the expander sleeve 50 contacts upper stop 16 of the housing.

Testing of the earth formation can thus be carried out by pumping fluid under pressure directly down the drill string casing and through the hollow mandrel whereupon the peripheral sealing lip or rim of the hollow truncated cone shape packer cup seal P is further expanded into sealing engagement with the borehole wall.

Figure 4:
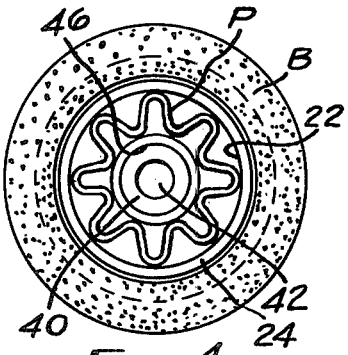
FIG. 4 is a bottom view looking up toward the lower end of the drill string, core drill bit and packer device therein of FIG. 1 and showing the prepacked resilient packer cup seal contracted to a pleated form of smaller diameter within the smaller end chamber of the housing.
Figure 5:
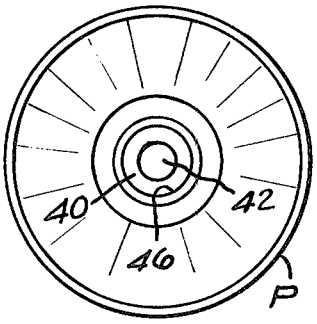
FIG. 5 is a bottom view looking up toward the lower end of the ejected and expanded packer cup seal of FIG. 2.

Following testing, the packer device 10 may be retrieved and hoisted to the surface by pulling upwardly on the attached wireline and attached inner mandrel 12. Upward movement of the inner mandrel 40 relative to the housing 12, still locked at this time to the drill string casing C, pulls and contracts the packer cup seal P into the chamber and pleated form shown in FIG. 4, releases the O-ring seal R and lastly upon engagement of the annular flange 44 with shoulder 18 and simultaneous alignment of the transverse bore 28 and groove 48 of the inner mandrel 40 the locking means 30 releases the housing 12 and device from the casing C.

Arriving at the top of the casing, the funnel place therein engages the emerging latches 76 to prevent accidental release of the device removed therewith from the casing C.

As many embodiments of the invention are possible it is to be understood that the embodiments disclosed and described hereinabove is solely for illustrative purposes and the invention includes all embodiments, modifications and equivalents thereof falling within the scope of the appended claims.

I claim:

1. A wireline supported mechanically operable packer device adapted for use in combination with and within a tubular drill string casing attached to a core drill bit having an internal shoulder and bore and raised to a site situated above a bottom of a bore hole for sealing off and testing the formation about a portion of the bore hole therebelow comprising:

an outer housing including a central bore extending axially between axially spaced upper and lower stop surfaces, a lower end chamber adjacent to and extending from the lower stop surface to a lower open end of the chamber and housing, and a lower end portion and surface adapted for abutting engagement with the internal shoulder of the core drill bit about the lower open end of the housing;

an inner hollow mandrel slideably mounted in the central bore for limited axial movement between the axially spaced stop surfaces and to extended and contracted positions relative to the housing and having a central internal passage extending axially from an upper entrance end connected to an inner bore of the casing to a lower exit end adjacent a lower open end of the housing;

resilient expandable packer seal means attached to, movable with and by the inner hollow mandrel having an upper end portion attached to the lower end portion of the inner hollow mandrel and a lower open end portion extending from the upper end portion and normally drawn into, contracted and stored within the lower end chamber of the housing during axial movement of the mandrel to the extended position and ejected from the lower end chamber into sealing engagement with the bore hole wall during axial downward movement of the mandrel to the contracted position;

a resilient seal ring adapted to engage an upper surface of the housing surrounding a portion of the inner mandrel;

expander means about a portion of the inner mandrel for internal sealing engagement with, expanding and compressing the resilient seal ring into sealing engagement with the internal surface of the casing wall upon axial movement of the inner mandrel, expander means and packer seal means to the contracted sealing position; and wireline means connected to the inner mandrel for lowering and retrieving the packer device within the drill string casing to and from sealing engagement with the bore hole wall.

2. A wireline supported mechanically operable packer device according to claim 1 further comprising:

locking means in the housing, casing and inner mandrel operable by displacement of the inner hollow mandrel relative to the housing from a fully extended unlocked position toward the contracted position for locking the housing to the casing.

3. A wireline supported mechanically operable packer device according to claim 2 wherein the locking means comprises:

an internal locking groove in the casing, a radial aperature in the housing wall extending from the central bore to a sidewall opening situated opposite the internal locking groove in the casing, a locking element of greater maximum radial dimension than the thickness of the housing wall in the radial aperature, and an external groove in the inner mandrel opposite the radial aperature and into which a portion of the locking element protrudes when the mandrel is in the extended unlocked position and which locking element is forced radially out of the external groove in the mandrel and projected through the side opening into locking engagement with the internal locking groove in the casing by and during movement of the inner mandrel toward the contracted position relative to the housing.

4. A wireline supported mechanically operable packer device according to claim 1 wherein the expander means comprises:

a removable tapered sleeve attached to a portion of the inner mandrel and having a lower end shoulder adapted to engage the upper stop surface of the housing and limit the downward axial movement of the inner mandrel to the contracted position relative to the housing, and a tapered surface extending upwardly from a lower portion of smaller diameter to an upper portion of the tapered sleeve of sufficiently larger diameter than a normal contracted internal diameter of the resilient seal ring.

5. A wireline supported mechanically operable packer device according to claim 1 further comprising:

weight means added to the inner mandrel for displacing and contracting the inner mandrel relative to the housing and ejecting the packer seal means from the end chamber of the housing following the engagement of the lower end portion and surface thereof with the internal shoulder of the core drill bit.

6. A wireline supported mechanically operable packer device according to claim 5 wherein the weight means comprises:

a relatively heavy enlongated rod including a lower end portion coupled to an upper end of the inner mandrel, a radial passage connected to the upper entrance end of the central internal passage of the inner mandrel, and an upper end portion coupled to the lower end portion of the wireline means.

7. A wireline supported mechanically operable packer device according to claim 1 further comprising:

a support flange at the lower end portion of the inner mandrel having;

an upper angular shoulder surface which engages the lower stop surface of the housing when the mandrel is in the extended non-sealing position, a lower surface in supporting engagement with the upper end portion of the resilient expandable packer seal means, and seal retaining means extending from the support flange and situated in a central mounting hole in the upper portion of the packer seal means for retaining the packer seal means to the inner mandrel.

8. A wireline supported mechanically operable packer device according to claim 1 wherein the resilient expandable seal means comprises:

a hollow truncated cone shape seal cup including an upper portion having an upper surface, and a central mounting hole;

a relatively thin collaspable flexible flared wall portion extending continuously around an internal chamber and flaring outwardly and downwardly from the upper portion; and a relatively thin collaspable flexible annular lower sealing wall portion of larger diameter extending from the flared wall portion and around adjacent a lower open end of the internal chamber and seal cup.

9. A wireline supported mechanically operable packer device according to claim 1 wherein the wireline means comprises:

a latch mechanism including a latch support coupled to the weight means and inner mandrel, resilient strips each attached at one end to and extending upwardly from the latch support, opposing latches attached to the upper opposite ends of the resilient strips and each having an internal recess adapted to receive and latch onto a mating enlarged lower head portion of a lowering tool means adapted for coupling to a wireline.

* * * * *